US008100280B1

(12) United States Patent
Hernandez

(10) Patent No.: US 8,100,280 B1
(45) Date of Patent: Jan. 24, 2012

(54) COLLAPSIBLE LAUNDRY HAMPER

(75) Inventor: Rolando Hernandez, Chicago, IL (US)

(73) Assignee: Home Products International, Inc., Chicago, IL (US)

( * ) Notice: Subject to any disclaimer, the term of this patent is extended or adjusted under 35 U.S.C. 154(b) by 493 days.

(21) Appl. No.: 11/615,486

(22) Filed: Dec. 22, 2006

Related U.S. Application Data

(60) Provisional application No. 60/755,543, filed on Dec. 30, 2005.

(51) Int. Cl.
*B65D 6/00* (2006.01)

(52) U.S. Cl. ..... 220/9.4; 220/4.33; 206/278

(58) Field of Classification Search ..... 220/4.34, 220/4.33, 4.28, 7, 693, 692, 677, 9.2, 9.3, 220/9.4, 666, 907, 6; 248/150, 155, 50, 95, 248/101; 135/125, 126, 127, 128, 130, 143, 135/142, 144; 206/278
See application file for complete search history.

(56) References Cited

U.S. PATENT DOCUMENTS 1,581,888 A * 4/1926 Thomas ..... 222/572
3,105,617 A * 10/1963 Felldin ..... 222/181.3
4,640,328 A * 2/1987 Arney ..... 220/9.1
4,705,246 A * 11/1987 Wolf ..... 248/97
4,819,582 A * 4/1989 Lichvar ..... 119/474
4,979,531 A 12/1990 Toor et al.
4,981,387 A 1/1991 Younjae
5,222,536 A * 6/1993 Hodgdon et al. ..... 141/390
5,289,937 A * 3/1994 Boots ..... 220/9.1
5,333,634 A * 8/1994 Taylor ..... 135/98
5,356,024 A 10/1994 Ho et al.
5,464,113 A 11/1995 Ho et al.
5,511,807 A * 4/1996 Snyder ..... 280/47.26
5,544,781 A * 8/1996 Mattesky ..... 220/9.4
5,671,858 A * 9/1997 Hsu ..... 220/9.2
5,771,912 A 6/1998 Swetish
5,897,012 A * 4/1999 Sortwell ..... 220/4.28
5,964,533 A 10/1999 Ziglar
6,042,297 A 3/2000 Lah
6,089,394 A 7/2000 Ziglar
6,230,728 B1 5/2001 Reese
6,523,558 B1 2/2003 Gillis
6,588,620 B1 7/2003 Thuma et al.
6,805,334 B2 * 10/2004 Forsberg et al. ..... 254/134.3 FT

* cited by examiner

*Primary Examiner* — Jacob K Ackun
*Assistant Examiner* — Kareen Rush
(74) *Attorney, Agent, or Firm* — Michael G. Kelber; Neal, Gerber & Eisenberg LLP

(57) ABSTRACT

A collapsible laundry hamper comprising a collapsible frame and a panel member removably attached to the frame to enclose and define the hamper. The frame includes a top frame member, a bottom frame member, and a set of elongate upright frame members disposed therebetween. Each of the upright frame members comprises at least two sub-members. The members are biased into engagement with each other via a biasing member. The biasing member maintains the frame members in a rigid frame position. The members are capable of being pulled apart against the biased engagement provided by the biasing member and articulated to allow the frame to be placed into a collapsed position. When either one of the top frame member and the bottom frame member is pulled away from the other in the collapsed position, the frame is urged to return to the rigid frame position under the influence of the biasing members.

38 Claims, 4 Drawing Sheets

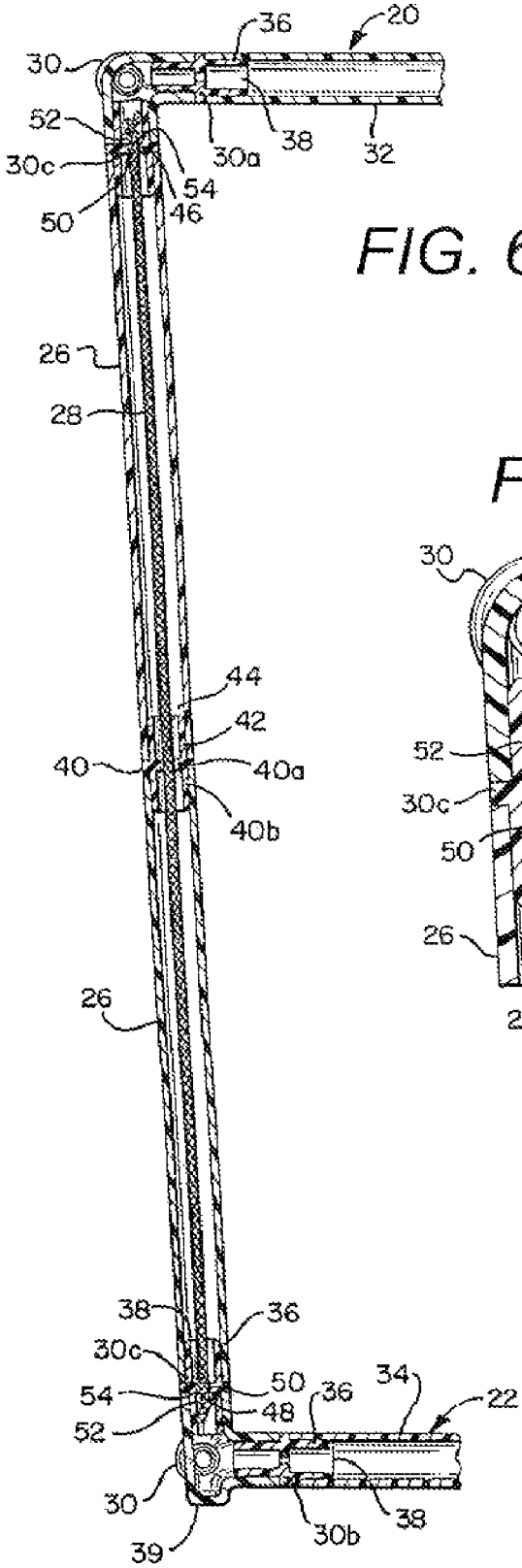
FIG. 6
FIG. 6a
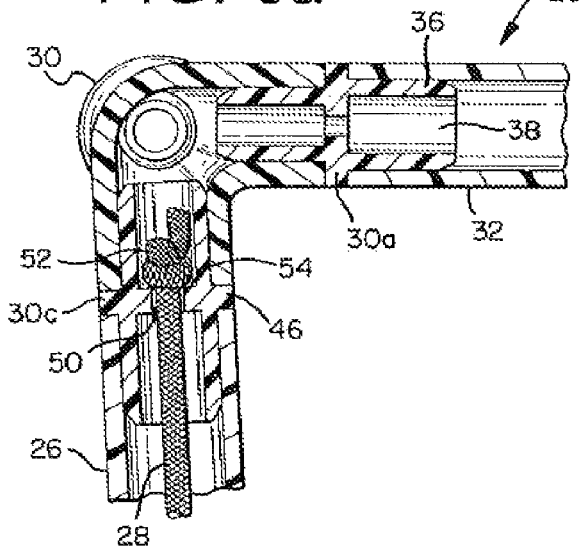

COLLAPSIBLE LAUNDRY HAMPER

CROSS-REFERENCE

This invention claims the priority of U.S. Provisional Patent Application Ser. No. 60/755,543 filed on Dec. 30, 2005, which is hereby incorporated herein in its entirety.

TECHNICAL FIELD

The present invention generally relates to home products, such as laundry hampers, and more particularly to laundry hampers that are collapsible to allow for, among other things, portability and ease of storage.

BACKGROUND

In recent years, the home products industry has seen an increasing interest in intelligent, convenient, fresh and efficient designs that complement a wide range of home decors, without sacrificing design functionality. This trend has been accelerated by the recent popularity of home remodeling, design, and make-over programming on television. In light of these trends, many household products have seen renewed design treatment.

One such product that has not seen a lot of such attention, however, is the laundry hamper. Many existing designs, while functional, do not offer a fresh and updated treatment, nor do they incorporate newly innovative features making them more versatile and functional. The present invention provides a laundry hamper design incorporating many design aspects, including functionality, convenience, versatility, efficiency and style, to name a few.

SUMMARY OF THE INVENTION

The present invention is directed to a collapsible laundry hamper. According to a particular aspect, the hamper comprises a collapsible frame and a panel member removably attached to the frame to enclose and define an interior space of the hamper with an opening to access the interior space of the hamper. The frame includes a top frame member, a bottom frame member, and a set of elongate upright frame members disposed therebetween. Each of the upright frame members comprises at least two sub-members biased into engagement with each other via a biasing member. Each of the upright frame members are also biased into engagement with the top and bottom frame members via the biasing member. The biasing member maintains the frame members in a rigid frame position. The sub-members and the top and bottom frame members are capable of being pulled apart against the biased engagement provided by the biasing member and articulated to allow the frame to be placed into a collapsed position. The articulation of the sub-members and the frame members creates additional force via the biasing members in the collapsed position such that when either one of the top frame member and the bottom frame member is pulled away from the other in the collapsed position, the frame is urged to return to the rigid frame position under the influence of the biasing members.

Other aspects will become apparent and be more fully understood from the drawings, descriptions, and claims set forth herein.

BRIEF DESCRIPTION OF DRAWINGS

FIG. 6 is a partial cross-sectional view of the frame shown in FIG. 2 taken along section line 6-6.

FIG. **6*a* is a detail view of a section of the frame shown in FIG. 6**.

Figure 2:
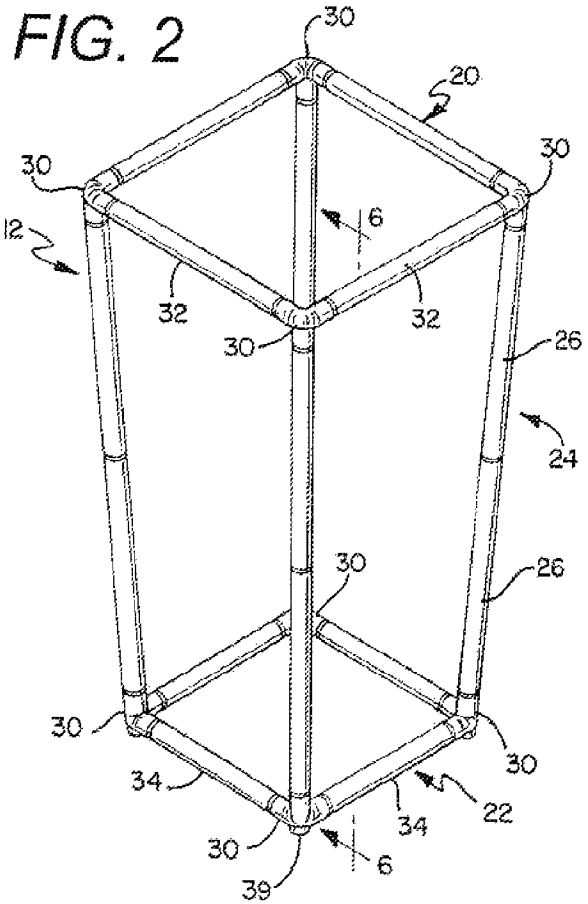
FIG. 2 is a perspective view of a frame of the collapsible hamper shown in FIG. 1.
Figure 7:
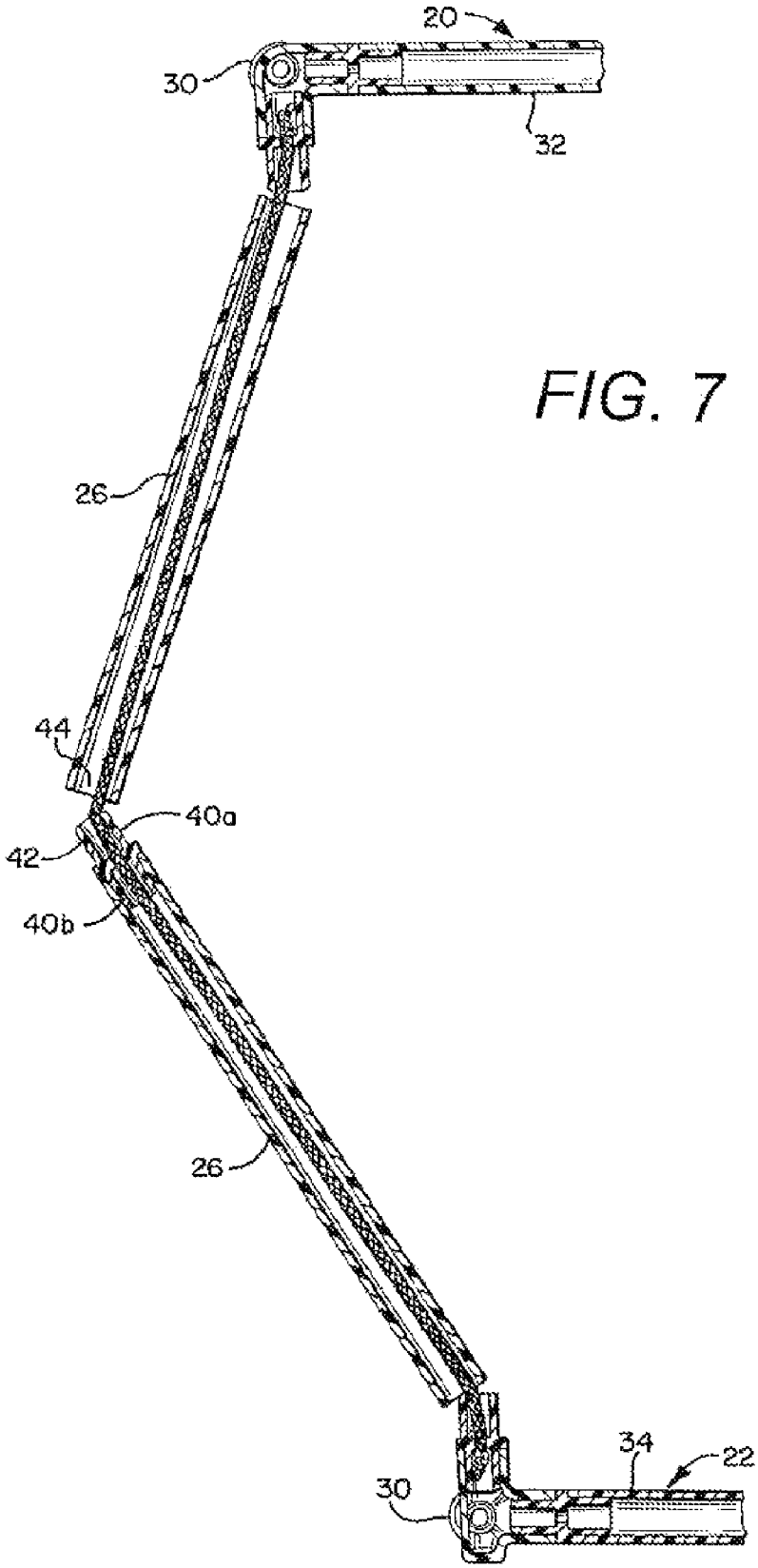

FIG. 7 is a partial cross-sectional view of the frame shown in FIG. 2 taken along section line 6-6 in an initial disengaged position.

DETAILED DESCRIPTION OF PREFERRED EMBODIMENTS

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers in cases where such labeling facilitates a more clear description. Additionally, the drawings set forth herein are not necessarily drawn to scale, and in some instances proportions may have been exaggerated to more clearly depict certain features.

Figure 1:
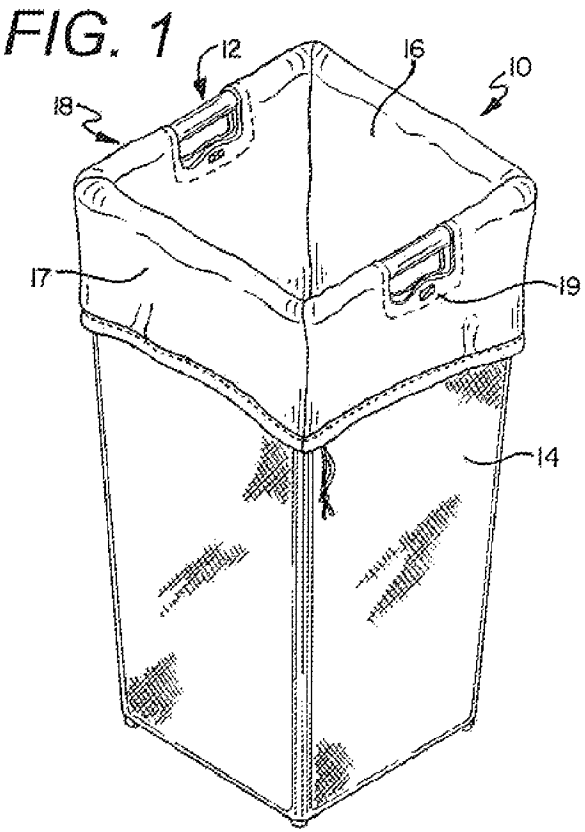
FIG. 1 is a perspective view of a collapsible hamper embodiment in accordance with the principles of the present invention.

Referring to FIGS. 1 and 2, a collapsible laundry hamper 10 is shown, which incorporates the principles of the present invention. FIG. 1 shows the hamper 10 in a fully-assembled state. The hamper 10 includes a collapsible frame 12 (shown in FIG. 2) and a panel member 14 (shown in FIG. 1) removably attached to the frame 12 to enclose and define an interior space 16 of the hamper 10 with an opening 18 to access the interior space 16 of the hamper 10. In a preferred embodiment, the panel member 14 is attached to the frame 12 via a plurality of hook and loop fasteners, such as those manufactured by Velcro Industries B.V. under the trade name Velcro®. Other fastening mechanisms can be employed as well, including other mechanical fasteners, such as hooks, clips, snaps, or the like. In a preferred embodiment, the panel member 14 is in the form of a bag having a generally rectangular-shaped periphery, such as that shown in FIG. 1. In another preferred embodiment, the panel member is made out of a canvas material. Other materials, however, are contemplated and can be utilized, such as other cotton or natural fiber fabrics, synthetic or synthetic blend fabrics, such as nylon or nylon mesh, flexible plastic sheet material, or the like. Additionally, the panel member can also take the form of multiple separate panels as opposed to a single bag-like structure. In other embodiments, the panel member may take the form of several flat and rigid structures that cooperate to enclose the frame 12. In a preferred embodiment, as shown in FIG. 1, a second bag 17 is disposed within the interior space 16 of the hamper 10 and within the panel member 14. The second bag 17, which acts as a liner for the hamper and is a removable laundry bag for toting laundry, can also be attached to the frame 12 via a hook and loop fastener 19, or the like.

As shown in FIG. 2, the frame 12 includes a top frame member 20, a bottom frame member 22, and a set of elongate upright frame members 24 disposed therebetween. While the frame members illustrated in FIG. 2 take the form of structures constructed from tubular members in a specific geometric arrangement, it should be understood that these frame members can be constructed from many different structures having various form factors. Additionally, these members can be arranged in other geometric formats as well and still function in accordance with the principles of the present invention. In a preferred embodiment, as shown in FIGS. 1 and 2, the top frame member 20 is larger than the bottom frame member 22, which allows the opening 18 to be larger for better access to the interior space 16 of the hamper 10.

Figure 3:
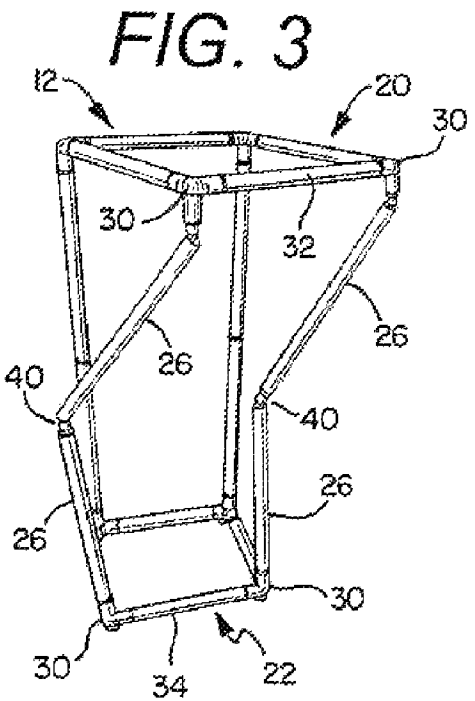
FIG. 3 is a perspective view of the frame shown in FIG. 2 in an initial disengaged position.
Figure 4:
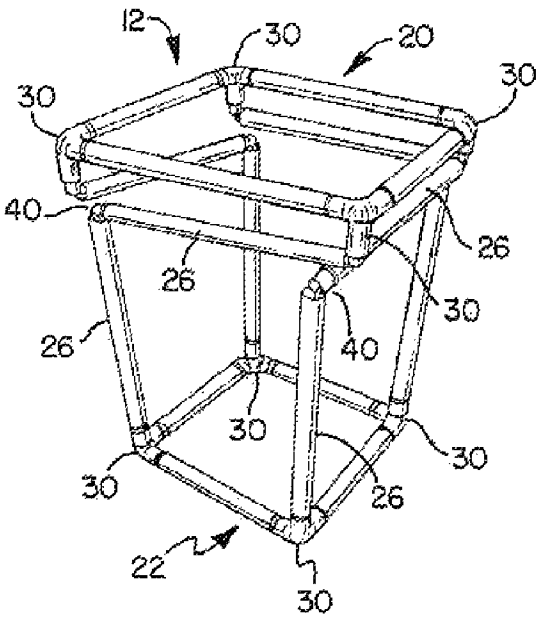
FIG. 4 is a perspective view of the frame shown in FIG. 2 in an intermediate collapsed position.

As will be described in more detail below, the collapsible hamper 10 is capable of being disengaged, articulated, and collapsed into a collapsed position, as illustrated by the progressive figures shown in FIGS. 3-5.

To help facilitate the collapsible feature of the hamper 10, each of the upright frame members 24 comprises at least two sub-members 26 biased into engagement with each other via a biasing or elastic member 28 disposed therewithin, which best shown in the cross-sectional view of FIG. 6. Each of the upright frame members 24 are also biased into engagement with the top and bottom frame members 20, 22 via the biasing members 28 disposed within each of the upright frame members 24 and connected to the top and bottom frame members 20, 22. The biasing members 28 maintain the frame members 20, 22, 24 in a rigid frame position, as that shown in FIG. 2. Each of the biasing members 28 is pre-loaded with a predetermined amount of tension to provide the necessary biased engagement of the frame members 20, 22, 24, as well as the sub-members 26. The predetermined tension can be varied in magnitude, depending on the desired feel to a user articulating the frame members 20, 22, 24 to place the frame 12 in the collapsed state. The tension should also be sufficient to adequately maintain the frame 12 in its rigid state. It should be noted that the cross-sectional view shown in FIG. 6 is similar for each of the upright frame members 24 and its engagement with the top and bottom frame members 20, 22. For simplicity of illustration, only one cross-section is shown.

Figure 5:
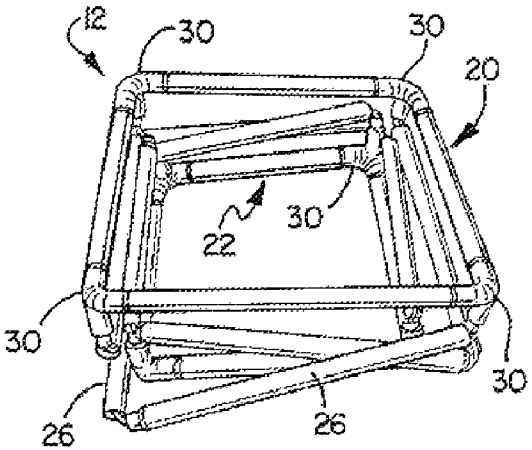
FIG. 5 is a perspective view of the frame shown in FIG. 2 in a fully collapsed position.

The sub-members 26 of the upright frame members 24, and the top and bottom frame members 20, 22 are capable of being pulled apart against the biased engagement provided by each of the biasing members 28 and articulated to allow the frame to be placed into a collapsed position, as shown in FIG. 5. The articulation of the sub-members 26 of the upright frame members 24 and the frame members 20, 22 creates additional force via the biasing members 28 in the collapsed position such that when either one of the top frame member 20 and the bottom frame member 22 is pulled away from the other in the collapsed position, the frame 12 is urged to return to the rigid frame position (shown in FIG. 2) under the influence of the biasing members 28.

Referring to FIG. 2 and the cross-sectional view of FIG. 6, the upright members 24 of the frame 12 are preferably constructed from tubular structures, or other structures having a passage therein, which allows the biasing members 28 to be disposed therein and pass therethrough for connection to the top and the bottom frame members 20, 22. In a preferred embodiment, the top and the bottom frame members 20, 22 are also constructed from similar tubular structures for consistency and integration of design. In a preferred embodiment, the tubular structures are made of poly-vinyl chloride (PVC), chlorinated poly-vinyl chloride (CPVC), polyethylene, polypropylene, or other polymeric materials suitable for such structures. Additionally, the tubular structures may be made of a composite, such as fiberglass or fiber-reinforced materials. Metal tubing can also be utilized, such as aluminum or powder-coated steel tubing. Additionally, the tubular structures can have any type of cross-sectional geometry, such as a circular, elliptical, or rectangular cross-sectional geometry.

Referring to FIG. 2 and the cross-sectional view of FIG. 6, the top and the bottom frame members 20, 22 preferably include a set of frame connectors 30 that facilitate engagement with the upright frame members 24. In the embodiment shown in FIG. 2, due to the rectangular periphery of the top and the bottom frames 20, 22, the frame connectors 30 are in the form of corner connectors each having three sub-member connection portions 30*a*, 30*b*, and 30*c*, which are more easily seen in cross-section in FIGS. 6 and 6*a*. In the embodiment shown in FIG. 2, the top and the bottom frame members 20, 22 are constructed from a set of four sub-members 32 and 34 respectively. The sub-member connection portions 30*a* and 30*b* of each frame connector 30 each engage either an end of one of the sub-members 32 or 34. The sub-member connection portion 30*c* of each frame connector engages an end of one of the sub-members 26 of the upright frame members 24, thereby defining a biasing or elastic frame member joint. As shown in the cross-section of FIGS. 6 and 6*a*, each of the sub-member connection portions 30*a*, 30*b* and 30*c* of the frame connectors 30 preferably comprise a male slip-fit connector 36 that engages a receptacle or open end 38 of a respective sub-member 26, 32, or 34. In a preferred embodiment, each of the frame connectors 30 of the bottom frame member 22 include a foot 39 to facilitate support of the hamper 10 in an upright position. The frame connectors 30 are preferably made from PVC, CPVC, polypropylene, polyethylene, or other polymeric material suitable for such structures, but can alternatively be made from a metallic material, or composite material, such as a carbon-based composite, fiber-reinforced composite, fiberglass, or the like.

In a preferred embodiment, to facilitate engagement between the sub-members 26 of the upright frame members 24, a slip fit joint 40 is provided having connection portions 40*a* and 40*b*, as best shown in FIGS. 6 and 7. In a preferred embodiment, the connection portions 40*a* and 40*b* each comprise a male slip fit connector 42 that is configured to engage a receptacle or open end 44 of one of the sub-members 26. In a preferred embodiment, one of the connection portions 40*a* or 40*b* is permanently affixed to one of the ends of one of the sub-members 26 so that the other connection portion is free to engage the open end of the other corresponding sub-member 26. As shown in FIG. 7, connection portion 40*b* is permanently affixed to the lower sub-member 26, which allows connection portion 40*a* to removably engage the open end 44 of the upper sub-member 26. The biasing member 28 passes through the joint 40, thereby defining an biasing or elastic sub-member joint.

When disengaged by pulling the sub-members 26 apart against the bias of the biasing member 28, the sub members 26 can be articulated with respect to each other as shown in FIG. 7, which creates additional bias via the biasing member 28. Likewise, disengagement of the sub-members 26 from the frame connectors 30 further allows articulation of the sub-members 26 with respect to each other as well as the top and the bottom frame members 20, 22. Referring to FIGS. 3-5, the sub-members 26 of the upright frame members 24, and the top and the bottom frame members 20, 22 are preferably articulated in the sequence shown in the figures. First, the sub-members 26 of each upright frame member 24 are disengaged at the joint 40 and at each frame connector 30 of the top frame member 20 (two of the upper sub-members 26 are shown disengaged as such in FIG. 3). Next, once disengaged from the upper sub-members 26, the top frame member 20 can be simultaneously rotated and lowered toward the remaining frame as shown in FIG. 4. These two steps can be repeated for the lower sub-members 26 and the bottom frame member 22, which results in the frame 12 being placed in the collapsed position shown in FIG. 5.

An effective implementation of the collapsible feature of the frame 12 is through use of the biasing members 28, which in a preferred embodiment as shown in FIG. 6, run contiguously through each of the upright frame members 24 between its respective frame connectors 30. In this embodiment, the biasing member 28 is an elongated cord-like elastic member, such as a bungee cord, rubber band, or the like. It should be noted, however, that the biasing member can also be a spring, such as a metallic coil spring, or any other structure that can provide a bias force, including technically "non-elastic" embodiments, and such embodiments are intended to be included within the meaning of the term "elastic member." As shown in FIG. 6, one end 46 of the biasing member 28 is connected to the top frame connector 30 and the other end 48 of the biasing member 28 is connected to the bottom frame connector 30. In a preferred embodiment, such as that shown in FIGS. 6, 6*a*, and 7, each end of the biasing member 28 is connected to its respective frame connector 30 by passing through an aperture 50 within the connector 30 and prevented from returning back therethrough by a knot 52 tied in the biasing member 28. The knot 52 bears against a bearing surface 54 of the connector 30 disposed around the aperture 50 to provide the necessary connection. Other connection configurations are contemplated as well, including connection by mechanical fasteners, integrated molding of the biasing member ends therein, adhesive, or other similar means for connecting. Additionally, the biasing members could be tied or fastened to a loop, hook, or other protrusion formed within the frame connector 30.

Although a contiguous biasing member 28 is shown in the figures, it is also contemplated that a plurality of biasing members can be utilized within each upright frame member 24. In such an arrangement, a separate biasing member would be provided at each point of engagement between the sub-members 26 and the top and the bottom frame members 20, 22, as well as between the sub-members 26 themselves at the joint 40. Additionally, as referenced above, while the preferred embodiments utilize an elastic biasing member, other embodiments, which may be non-elastic, are contemplated as well. For example, a mechanical joint, mechanism, or linkage could be utilized between the members, which would guide the frame into the rigid position with the force of gravity. In such embodiments, a locking mechanism could be incorporated to keep the mechanisms from allowing the frame to return into a non-rigid position. An example of such a locking mechanism is a collar or sleeve that slides over the joint to lock it in place.

In this example, the collar or sleeve could be designed to slide over the joint under the influence of gravity so that the frame can be placed in a rigid position in one step, rather than having to individually lock each joint.

Among the numerous benefits of the collapsible feature of the hamper 10, one that is of great interest to the manufacturing, distribution, and retail chain is the small package size required to package the hamper in the collapsed position. Many more units can be packaged together for shipment and distribution. From the retail side, less shelf or floor space would be required for presentation to the consumer. This results in cost savings at many levels within the distribution chain.

In the collapsed position, the frame 12, the panel member 14, and the second bag 17 can all be packaged in a relatively flat package, such as a plastic bag. The packaging also helps maintain the frame 12 in the collapsed position by resisting the bias applied by the biasing members 28 until it is removed from the packaging. Alternatively, the frame 12 can be secured by a band or other structure to help maintain it in the collapsed position. When unpackaged and/or unsecured, the frame 12 can be placed in the rigid frame position under the influence of the bias applied by the biasing members 28 when either one of the top or bottom frame members is pulled away from the other. Once the frame 12 is placed in the rigid frame position as shown in FIG. 2, the panel member 14 and the second bag 17 can be attached to the frame as shown in FIG. 1 to complete the assembly of the hamper 10.

While one or more specific embodiments have been illustrated and described in connection with the present invention, it is understood that the present invention should not be limited to any single embodiment, but rather construed in breadth and scope in accordance with recitation of the appended claims.

What is claimed is:

1. A collapsible laundry hamper comprising:

a collapsible frame comprising a top frame member, a bottom frame member, and a set of elongate upright frame members disposed therebetween, each of the upright frame members comprising at least two sub-members biased into engagement with each other via a biasing member, each of the upright frame members biased into engagement at a top end with the top frame member and at a bottom end with the bottom frame member via the biasing member into a rigid frame position, the sub-members and the top and bottom frame members capable of being pulled apart against the biased engagement and articulated to allow the frame to be placed into a collapsed position; and a panel member removably attached to the frame to enclose and define an interior space of the hamper, the panel member further defining an opening to access the interior space of the hamper, wherein, the biasing member associated with each upright frame member is affixed at one end to the top frame member and at another end to the bottom frame member, thereby causing biasing engagements at the top end of the upright frame member with the top frame member and at the bottom end of the upright frame member with the bottom frame member.

2. The hamper of claim 1, wherein the set of upright frame members comprise four frame members extending between the top and bottom frame members.

3. The hamper of claim 1, wherein the top and bottom frame members each define a rectangular periphery.

4. The hamper of claim 1, further comprising a plurality of frame connecting members attached to the top and bottom frame members to facilitate engagement with the upright frame members.

5. The hamper of claim 4, wherein each of the frame connecting members includes a slip fitting that engages its respective upright frame member.

6. The hamper of claim 5, wherein each end of each of the upright frame members include a receptacle configured to accept the slip fitting of its respective frame connecting member.

7. The hamper of claim 1, wherein each of the upright frame members has a passage therein along its length and wherein the biasing member is disposed within the passage, the biasing member of each upright frame member being connected to the top and bottom frame members in tension and contiguous therebetween, thereby causing biased engagement between the frame members and sub-members.

8. The hamper of claim 1, wherein the top frame member, the bottom frame member and the upright frame members are tubular.

9. The hamper of claim 8, wherein the upright frame members comprise PVC tubing.

10. The hamper of claim 1, wherein the top and bottom frame members further comprise sub-members connected to each other to form its respective frame member, the respective sub-members of the top and bottom frame members are arranged in a rectangular periphery and connected at each corner of the periphery to a corner frame connecting member.

11. The hamper of claim 10, wherein the rectangular periphery of the top frame member is larger than the rectangular periphery of the bottom frame member.

12. The hamper of claim 11, wherein the top, bottom, and upright frame members have a tubular construction having open ends.

13. The hamper of claim 10, wherein the corner frame connecting member includes three connection portions each generally transverse to the other connection portions, two of the connector portions each connected to one of two of the sub-members, and one of the connector portions removably connected to one of the upright frame members, each of the connecting member comprises a male slip-fit connector that engages the open end of the respective frame member.

14. The hamper of claim 13, wherein the male slip-fit connector corresponding to the open end of each of the upright frame members can be disengaged therefrom by pulling them apart against the bias of the biasing member, thereby allowing the upright frame members to be articulated with respect to the top and the bottom frame members.

15. The hamper of claim 1, wherein the sub-members of each upright frame member are removably engaged to each other via a slip fit joint that, when disengaged by pulling them apart against the bias of the biasing member, allows the sub members to be articulated with respect to each other.

16. The hamper of claim 1, wherein the panel member comprises an outer bag having an open top end having a generally rectangular-shaped periphery, the top end of the outer bag being removably attached to the top frame member and enclosing the frame.

17. The hamper of claim 16, further comprising a laundry bag disposed within the outer bag.

18. The hamper of claim 1, wherein the frame returns to the rigid frame position under the influence of the bias of the biasing members when either one of the top frame member and the bottom frame member is pulled away from the other in the collapsed position.

19. A collapsible laundry hamper comprising:

a collapsible frame comprising a top frame member, a bottom frame member, and a set of upright frame members disposed therebetween, each of the upright frame members comprising at least two sub-members biased into engagement with each other via a biasing sub-member joint, each of the upright frame members biased into engagement with the top frame member via a top biasing frame member joint and with a bottom frame member via a bottom biasing frame member joint to form a rigid frame position, the sub-members and the top and bottom frame members capable of being pulled apart from biased engagement with each other and articulated to allow the frame to be placed into a collapsed frame position, a biasing member associated with each upright frame member passing through the biasing sub-member joint and corresponding sub-members and connected at one end to the top frame member and at another end to the bottom frame member thereby causing a biasing engagement, associated with the top biasing frame member joint, at the top end of the upright frame member with the top frame member and a biasing engagement, associated with the bottom biasing frame member joint, at the bottom end of the upright frame member with the bottom frame member; and a panel member removably attached to the frame to enclose and define an interior space of the hamper, the panel member further defining an opening to access the interior space of the hamper.

20. The hamper of claim 19, wherein the set of upright frame members comprise four frame members extending between the top and bottom frame members.

21. The hamper of claim 19, wherein the top and bottom frame members each define a rectangular periphery.

22. The hamper of claim 19, further comprising a plurality of frame connecting members attached to the top and bottom frame members to facilitate engagement with the upright frame members.

23. The hamper of claim 22, wherein each of the frame connecting members includes a slip fitting that engages its respective upright frame member.

24. The hamper of claim 23, wherein each end of each of the upright frame members include a receptacle configured to accept the slip fitting of its respective frame connecting member.

25. The hamper of claim 19, wherein the biasing sub-member joint includes a biasing member and a slip fit connection between the sub-members that, when disengaged by pulling the sub-members apart against the bias of the biasing member, allows the sub-members to be articulated with respect to each other to facilitate placing the frame in the collapsed position.

26. The hamper of claim 19, wherein the panel member comprises an outer bag having an open top end having a periphery, the periphery of the top end of the outer bag being removably attached to the top frame member and enclosing the frame.

27. The hamper of claim 26, further comprising a laundry bag disposed within the outer bag.

28. The hamper of claim 19, wherein the frame returns to the rigid frame position under the influence of the bias applied at the biasing sub-member joint and the biasing frame member joint when either one of the top frame member and the bottom frame member is pulled away from the other in the collapsed position.

29. A collapsible laundry hamper comprising:

a top frame member having a plurality of top frame connectors;

a bottom frame member having a plurality of bottom frame connectors;

a plurality of upright frame members each having an upper end and a lower end, each upper end in removable engagement with one of the plurality of top connectors of the top frame member and each lower end in removable engagement with one of the bottom connectors of the bottom frame member, each of the upright frame members comprising at least two sub-members in removable engagement with each other at a joint, each of the ends of the upright frame members biased toward its respective connector via a biasing member and each of the sub-members biased toward each other at their respective joint via the biasing member; and a panel member removably attached to at least one frame member to define an interior space of the hamper, the panel member further defining an opening to access the interior space of the hamper, wherein, the frame members are capable of being articulated when disengaged to allow the hamper to be placed into a collapsed position, and the biasing member associated with each upright frame member is connected at one end to one of the top frame connectors of the top frame member and at another end to one of the bottom frame connectors of the bottom frame member thereby causing a biasing engagement at the top end of the upright frame member with the top frame member and a biasing engagement at the bottom end of the upright frame member with the bottom frame member.

30. The hamper of claim 29, wherein the plurality of upright frame members comprise four frame members extending between the top and bottom frame members.

31. The hamper of claim 29, wherein the top and bottom frame members each have a rectangular periphery defining a set of four corners each having a frame connector.

32. The hamper of claim 29, wherein each of the upright frame members comprises a tube.

33. The hamper of claim 32, wherein the biasing member of each tubular upright frame member is disposed therein and connected to its respective top and bottom frame members in tension and contiguous therebetween, thereby causing biased engagement between the frame members and sub-members and allowing disengagement by applying a force against the bias of the biasing member.

34. The hamper of claim 29, wherein the panel member comprises an outer bag having an open top end having a periphery, the periphery of the top end of the outer bag being removably attached to the top frame member and enclosing the frame.

35. The hamper of claim 34, further comprising a laundry bag disposed within the outer bag.

36. The hamper of claim 29, wherein the frame returns to the rigid frame position under the influence of the biasing members when either one of the top frame member and the bottom frame member is pulled away from the other in the collapsed position.

37. The hamper of claim 29, wherein each of the bottom frame connectors include a foot to facilitate support of the hamper in an upright position.

38. A collapsible laundry hamper comprising:

a top frame member defining a rectangular periphery and having a corner connector disposed at each corner of the frame member;

a bottom frame member defining a rectangular periphery and having a corner connector disposed at each corner of the frame member;

four upright frame members each having an upper end, a lower end, and an inner passage along its length, each upper end in removable engagement with one of the corner connectors of the top frame member and each lower end in removable engagement with one of the corner connectors of the bottom frame member, each of the upright frame members comprising at least two sub-members in removable engagement with each other at a joint, each of the ends of the upright frame members biased toward its respective corner connector via an elastic member and each of the sub-members biased toward each other at their respective joint via the elastic member, the elastic member connected at one end to one the corner connectors of the top frame member and at another end to one of the corner connectors of the bottom frame member, thereby causing a biasing engagement at the top end of the upright frame member with the top frame member and a biasing engagement at the bottom end of the upright frame member with the bottom frame member, and the elastic member is disposed within the inner passage of the upright frame member so that the elastic member is concealed when the frame members are engaged; and a panel member removably attached to at least one frame member to define an interior space of the hamper, the panel member further defining an opening to access the interior space of the hamper, wherein, the frame members are capable of being articulated when disengaged to allow the hamper to be placed into a collapsed position.

* * * * *